United States Patent [19]

Kuhn et al.

[11] Patent Number: 5,036,566

[45] Date of Patent: Aug. 6, 1991

[54] COVERED ORNAMENTAL CLASP AND APPARATUS FOR ITS PRODUCTION

[75] Inventors: Elmar Kuhn, Wuppertal; Hans-Jürgen Timmerbeul, Ennepetal; Günter Wittke, Sprockhövel, all of Fed. Rep. of Germany

[73] Assignee: Astor-Werk Otto Berning & Co. (GmbH & Co.), Schwelm, Fed. Rep. of Germany

[21] Appl. No.: 427,086

[22] PCT Filed: Dec. 9, 1988

[86] PCT No.: PCT/EP88/01134

§ 371 Date: Oct. 16, 1989

§ 102(e) Date: Oct. 16, 1989

[87] PCT Pub. No.: WO89/07405

PCT Pub. Date: Aug. 24, 1989

[30] Foreign Application Priority Data

Feb. 19, 1988 [DE] Fed. Rep. of Germany ..... 3805154

[51] Int. Cl.[5] ..... A44B 1/12

[52] U.S. Cl. ..... 24/90 C; 24/113 R; 24/113 MP

[58] Field of Search ..... 24/703.1, 703.2, 703.3, 24/703.4, 703.5, 703.6, 113 R, 113 MP, 90 R, 90 A, 90 C, 460, 461, 462, 522, 621

[56] References Cited

U.S. PATENT DOCUMENTS

| | | | |
|---|---|---|---|
| 1,118,555 | 11/1914 | Kanter | 24/90 C |
| 1,484,382 | 2/1924 | Allitt | 24/90 C |
| 2,214,030 | 9/1940 | Pereles | 24/113 MP |
| 2,643,430 | 6/1953 | Koehl et al. | 24/113 R |
| 2,654,927 | 10/1953 | Tansman | 24/113 R |
| 4,471,510 | 9/1984 | De Rosa | 24/90 A |
| 4,549,331 | 10/1985 | Coley | 24/113 R |
| 4,654,934 | 4/1987 | Hasegawa | 24/90 C |

*Primary Examiner*—Victor N. Sakran

*Attorney, Agent, or Firm*—Goodman & Teitelbaum

[57] ABSTRACT

The invention relates to a clasp having coverable clasp parts, comprising a clasp upper part (1) of dish-shaped cross section and, pressable into the latter, a clasp lower part (2) of dish-shaped cross section, the upper and lower surfaces facing one another and the internal space of the clasp serving to receive the ends (9) of the covering material (3) surrounding the clasp upper part (1). The lower surface and the upper surface of the clasp do not run parallel to one another. The plane (5) of the lower surface of the clasp lower part (2) runs parallel, however, to the plane (7) of the edges of the open underside (7) of the clasp upper part (1), and the open plane of the upper side (6) of the clasp lower part (2) runs parallel to the upper side (4) of the clasp upper part (1) forming the upper surface. Furthermore, the invention also relates to an apparatus for producing the fabric-covered clasp.

4 Claims, 3 Drawing Sheets

COVERED ORNAMENTAL CLASP AND APPARATUS FOR ITS PRODUCTION

Figure 1:
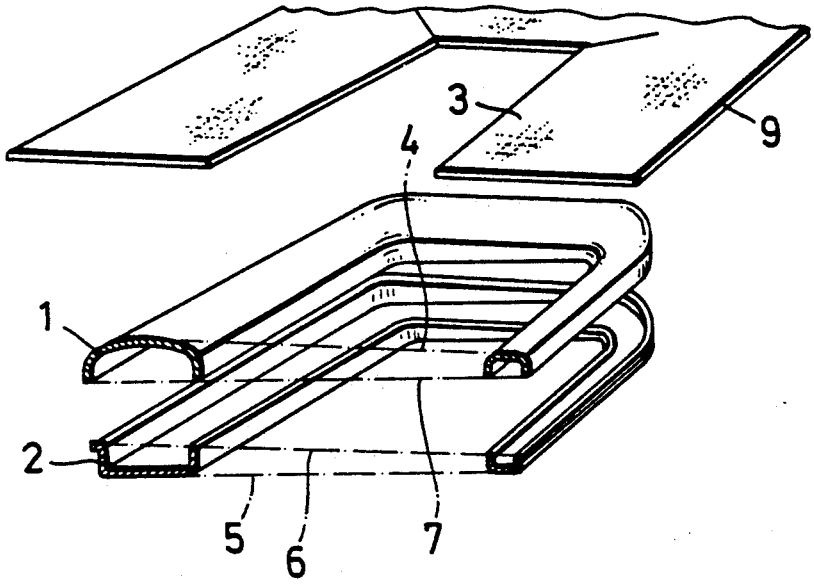

The present invention relates to a clasp having coverable clasp parts, comprising a clasp upper part of approximately dish-shaped cross section and, pressable into the latter, a clasp lower part of approximately dish-shaped cross section, the open upper and lower part sides facing one another and the internal space of the dish serving to receive the ends of the covering material surrounding the clasp upper part.

Furthermore, the invention relates to an apparatus for producing the clasp described above, comprising a lower tool for receiving the clasp lower part and an upper tool for receiving the fabric-covered clasp upper part, the lower tool having a lower part in which an inner core section is mounted and an outer core section comprising a base plate and a peripheral collar which engages in a gap, which is formed between the lower part and the inner core section and into which the clasp lower part is insertable, and at least the lower part being resiliently supported against the base plate, and the upper tool comprising an inner core section and an upper part surrounding the latter such that between this there is formed a peripheral gap for receiving the clasp upper part with the fabric cutout, in which an outer core section is displaceably guided.

This known apparatus serves to produce clasps covered with fabric, whereof the upper and lower surfaces run parallel to one another. Clasps in which the upper and lower surfaces do not run parallel to one another are currently of massive construction and have to be covered by hand, which is however expensive and time-consuming from a manufacturing point of view.

The present invention is based on the object of providing coverable clasps having upper and lower surfaces not running parallel to one another, these clasps being producible by machine, and an apparatus therefor.

According to the invention, this is achieved for a clasp of the type described at the outset in which the lower and upper surfaces do not run parallel to one another, the underside of the clasp lower part forming the lower surface running parallel to the open plane of the underside of the clasp upper part and the open plane of the upper side of the clasp lower part running parallel to the upper side of the clasp upper part forming the upper surface.

Based on this embodiment according to the invention, an apparatus of the type described at the outset can be used in accordance with the invention for its production, in which a reference plane running perpendicular to the axis of tool closure and separating movement is formed in the lower tool for receiving the clasp lower part, and a receiver having a bearing surface running obliquely to the axis is constructed in the upper tool for the clasp upper part and separating and shaping surfaces are constructed in the tools, these surfaces running at the same inclination to the reference plane as the upper surface of the clasp upper part does to its underside. Alternatively, a reference plane running obliquely to the axis of tool closure and separating movement at the same inclination as the upper surface of the clasp upper part does to its underside may be constructed in the lower tool for receiving the clasp lower part and a receiver having a bearing surface running perpendicularly or obliquely to the axis X—X may be constructed in the upper tool for the clasp upper part and separating and shaping surfaces may be constructed in the tools, these surfaces running perpendicular to the axis X—X.

Based on the invention, despite the existing asymmetry in the shape of the clasp, there is provided an unambiguous reference surface running perpendicular to the axis of tool closure and separation and permitting unambiguous association of the tool parts to one another.

Further advantageous embodiments are set forth below.

With reference to the exemplary embodiment of the clasp according to the invention and the apparatus according to the invention shown in the attached drawings, the invention will now be explained in more detail.

Figure 2:
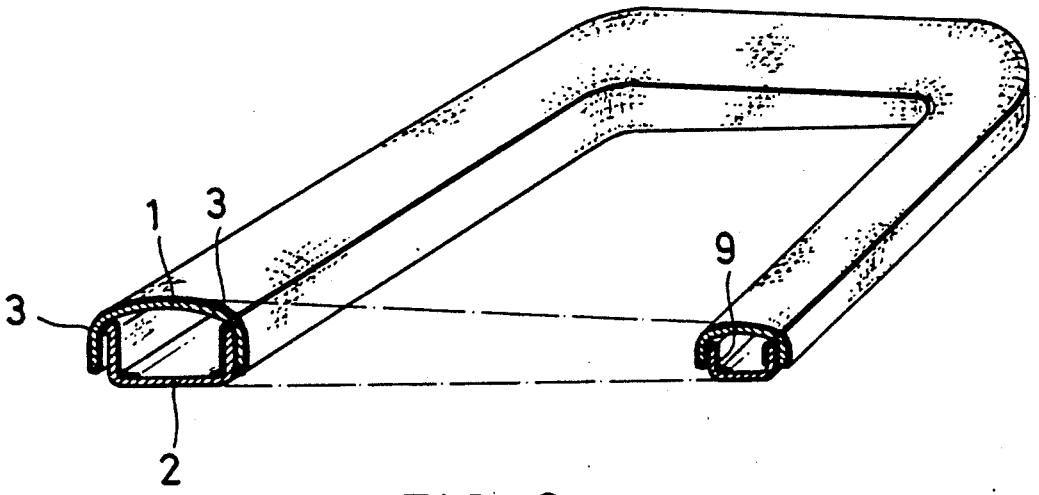
Figure 3:
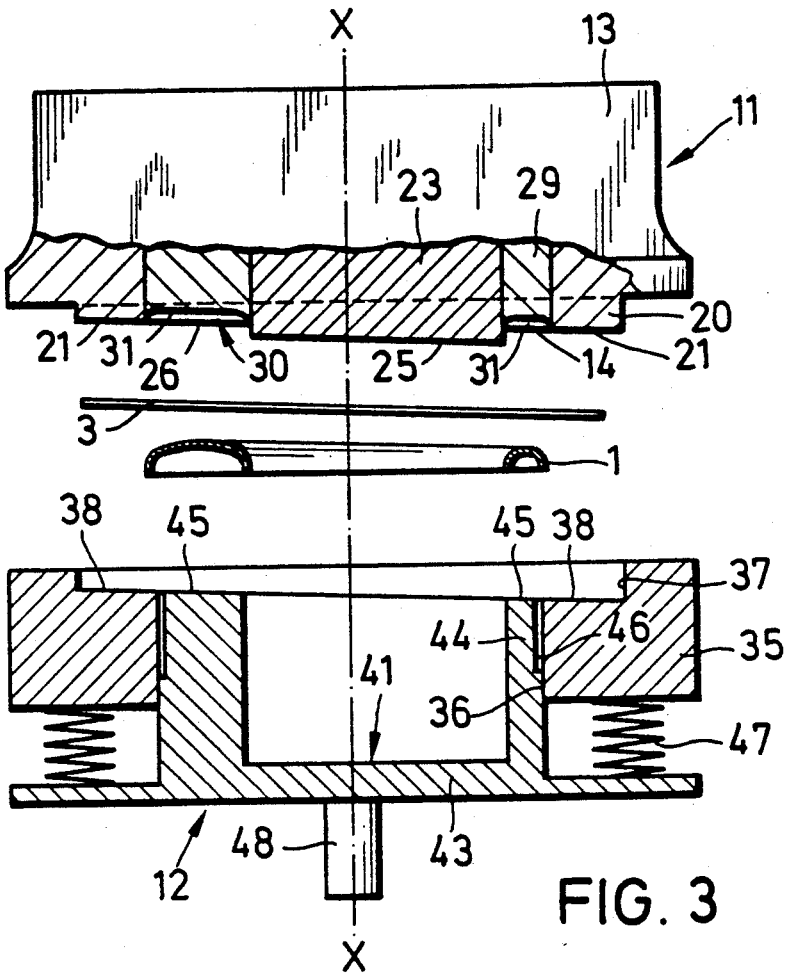
Figure 4:
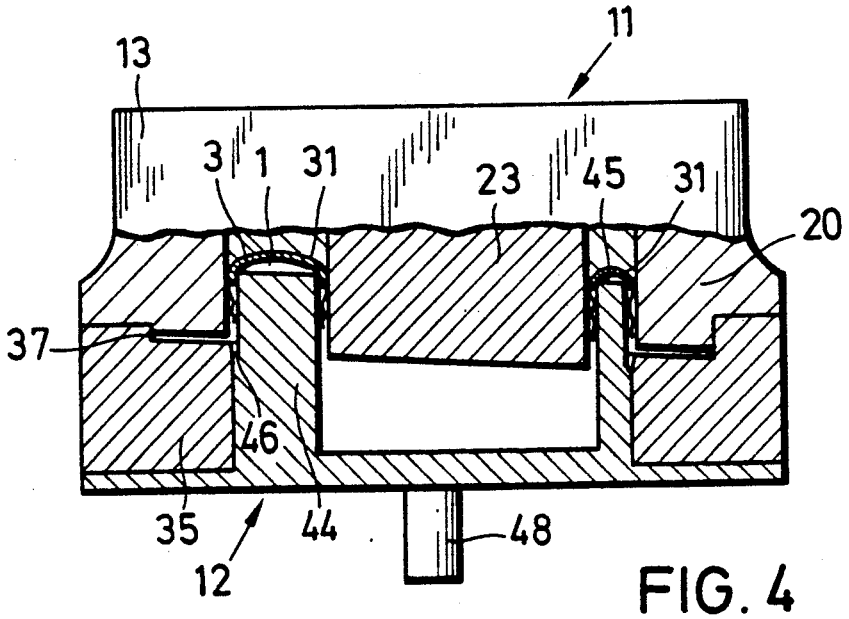
Figure 5:
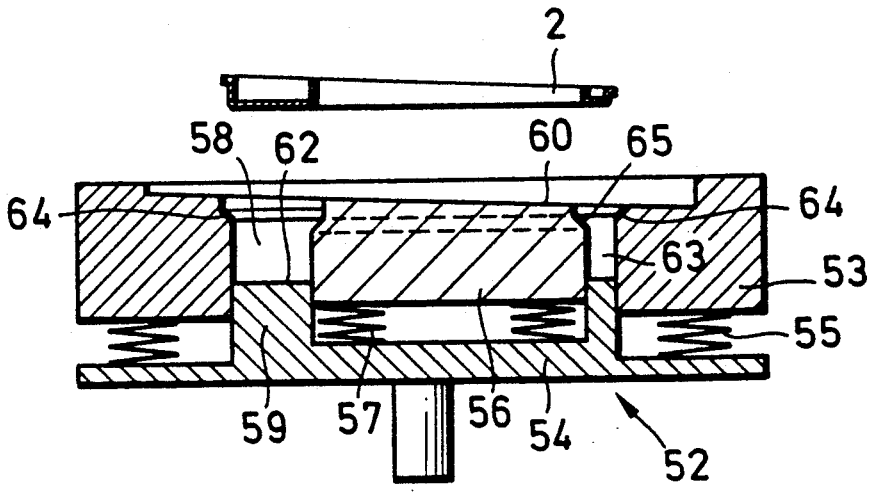
Figure 6:
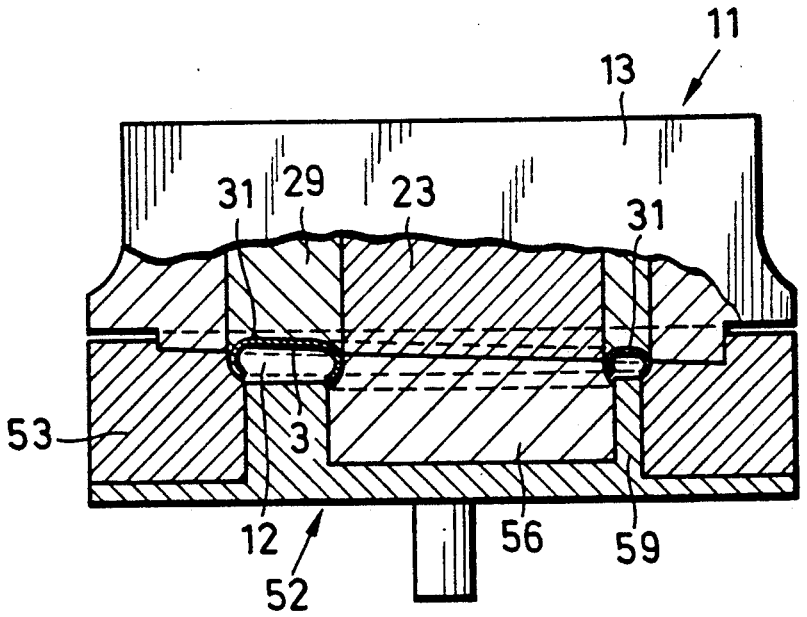

In the drawings:

FIG. 1 shows a perspective view, in partial section, of a clasp according to the invention in the non-assembled state, FIG. 2 shows the finished clasp produced from the parts of FIG. 1, in longitudinal section, FIG. 3 shows a diagrammatic representation of a section through an apparatus according to the invention, of an upper tool according to the invention and a lower tool according to the invention for receiving the fabric cutout and the clasp upper part, FIG. 4 shows a section according to FIG. 3, but in the final position of the pressed-together tools, FIG. 5 shows a diagrammatic representation of a section through an apparatus according to the invention, comprising a lower tool for receiving the clasp lower part, and FIG. 6 shows a section through the upper tool of FIG. 3 in the pressed-together state with the lower tool of FIG. 5.

An apparatus according to the invention comprises an upper tool 11 and a first lower tool 12 and a pressing apparatus (not shown) in which the two tools are placed, in the arrangement shown in FIG. 3.

The upper tool 11 comprises an upper part 13 which has a central through opening 14. The shape of the through opening is matched to the peripheral contour of a clasp to be covered with fabric (see FIGS. 1 and 2). This clasp is formed from a clasp upper part 1, a clasp lower part 2 and a fabric cutout 3. The two clasp parts 1, 2 comprise, in known manner, web-shaped metal sections forming a frame, whereof the peripheral edges produce a trough-shaped profile, for example a U-shaped profile or a dish-shaped cross section, where the upper surface can be bow-shaped, rectilinear and the like. The fabric cloth or fabric cutout 3 required for covering the upper part 1 of the clasp is cut such that a cover of approximately the same width remains on either side of the frame edges, both towards the outside and towards the inner opening. For this purpose, the fabric cutout 3 is provided in known manner in its centre with a longitudinal slit at the ends whereof are incisions diverging symmetrically from one another by 90°.

As shown in FIGS. 1 and 2, the upper surface of the upper part 1 is disposed in a plane 4, and the lower surface of the lower part 2 is disposed in a plane 5. The planes 4 and 5 are inclined relative to each other and therefore are not parallel to one another so that the upper and lower surfaces of the pressed together clasp are also not parallel to one another, as shown in FIG. 2. The edges of the open underside of the upper part 1 are disposed in a plane 7, the underside plane 7 being parallel to the plane 5 of the lower surface of the lower part 2. The edges of the open top side of the lower part 2 are disposed in a plane 6, the top side plane 6 being parallel to the plane 4 of the upper surface of the upper part 1. The internal space within the pressed together clasp serves to receive the ends 9 of the covering material 3.

On its underside facing the lower tool 12, the upper tool 11 has on its upper part 13 a peripheral extension 20 having a separating surface 21 on its end face. Within the through opening 14 of the upper part 13 there is mounted a core section 23 which is movably connected to the upper part 13. The separating surface 25 of the core section 23, facing the lower tool 12, runs obliquely with respect to the axis of tool separation and closure. The separating surfaces 21 of the extensions 20 are constructed appropriately so that the separating surfaces 21 form an extension of the surface 25. The core section 23 is fixed in the upper part 13 such that a peripheral gap 26 is formed between the core section 23 and the upper part 13. The upper tool 11 furthermore has an outer core section which comprises a head plate (not shown) and a peripheral wall 29 which surrounds a hollow space. The wall 29 is matched to the width and contour of the gap 26 as regards its thickness and profile, so that the gap 26 is closed towards the top by the wall 29 and forms a peripheral receiver 30. The contour of the receiver is profiled to be concave such that it forms a receiver for the fabric-covered upper part 1. The shaping surface 31 of the receiver 30 runs obliquely with respect to the axis X—X and parallel or obliquely to the separating surfaces 21, 25.

The individual parts of the upper tool 11 are arranged such that, on the one hand, the upper part 13, the core section 23 and the outer core section can be moved together in the direction of the lower tool 12 and, on the other hand, the outer core section can be displaced relative to the mutually connected upper part and core section.

The lower tool 12 comprises a lower part 35 having a central through opening 36 which is matched in its shape to the outer contour of the clasp upper part 1 and thus corresponds in its shape to the through opening 14 in the upper tool 11. In the side of the lower part 35 facing the upper tool 11 there is a receiver comprising a peripheral shoulder 37 whereof the contour corresponds to the negative profile of the extension 20 and has a separating surface 38. The space formed by the shoulder 37 serves to receive the fabric cutout 3 and is to this extent matched to the shape of this cutout. Within the through opening 36 there may be mounted a blank holder (not shown). Within the through opening 36 there is guided a fabric press which comprises a base plate 43 having a collar 44 offset towards the inside, the collar wall having a profile which corresponds to the shape of the through opening 36. The shaping surfaces 45 on the end face of the collar run at the same inclination to the axis X—X as the surfaces 38 of the shoulders 37. On the outside of the collar 44 there is made in the manner of a diameter reduction a peripheral shoulder 46. Here, the width of the shoulder is matched to the thickness of the edge of the clasp upper part. The width of the shaping surfaces 45 approximately corresponds to the width of the clasp upper part between the two edges of the upper part, that is to say between the outer and the inner edge of the clasp upper part. The lower part 35 is mounted resiliently with respect to the fabric press 41, the resilient mounting being by means of coil springs 47 which are supported on the base plate 43. Arranged on the outside of the base plate 43 is a pin 48 which serves to secure the lower part tool 12 in the press for receiving the upper tool 11.

The mode of operation using the apparatus according to the invention, illustrated in FIG. 3, is as follows and emerges from FIGS. 3 and 4.

The clasp upper part 1 is placed, with the fabric cutout 3 over it, in the lower part 35 in the region of the shoulder 37 on the separating surface 38. The entire upper tool 11 is moved downward onto the lower tool 12. When the upper tool 11 presses downward onto the lower tool 12 the upper part 13 presses the lower part 35 with the core section 23 downwards, as a result of which the clasp upper part 1 placed on the surfaces 45, together with the fabric cutout 3, is pressed upwards against the surfaces in the receiver 30, where it is positioned such that its underside plane 7 runs perpendicular to the axis X—X. Here, it is important that in the arrangement illustrated in FIG. 3, the surfaces 21, 25, 31 of the upper tool 11 and the surfaces 38, 45 of the lower tool run with the inclination to the axis X—X which corresponds to the conical shape of the finished clasp. With a vaulted profile of the upper side of the clasp upper part the corresponding contour is in the surfaces 21, 25, 31, 38, 45 so that the pressed-in clasp upper part has an underside running perpendicular to the axis X—X.

FIG. 4 illustrates the final position of the upper tool 11 on the lower tool 12 once the upper tool has been pressed downwards. In this final position the collar 44 projects into the receiver space 30 and has pushed the clasp upper part 1, with the fabric cutout 3 lying over it, into the receiver 30. FIG. 4 shows here the position of the fabric cutout 3 within the receiver space 30. In this case, the clasp upper part 1, together with the fabric cutout 3, is held on the inside in the upper tool 11 such that there is a slightly clamped fit, so that the upper part cannot fall out. Once the clasp upper part 1 has been pressed into the upper tool 11 together with the fabric cutout 3 in this manner, the side edges of the fabric cutout hanging downwards on both sides, the lower tool 12 can be disengaged by raising the upper tool.

The clasp upper part is now connected to the lower part in known manner, as for example disclosed by German Pat. No. 977 665. For this purpose, the previously described first lower tool 12 is replaced by a second lower tool 52 (see FIG. 5). This second lower tool 52 comprises a lower part 53 which is constructed as a holding frame. This lower part is supported against a base plate 54 of an outer core section by means of springs 55. In a recess 63 corresponding to the shape of the clasp lower part 2 there is resiliently mounted an inner core 56 acting as a counter-holder, by means of coil springs 57 supported on the base plate 54. The inner core section 56 forms with the lower part 53 a peripheral gap 58 and has a separating surface 60 on its end face. A collar 59 secured on the base plate 54 projects into the gap 58 and closes the latter towards the bottom. The clasp lower part 2 is placed on the end face of the shaping surface 62 of the collar 59 within the gap 58. The lower part 53 has a recess 60 which is radially enlarged with respect to the recess 63 and which serves to receive the peripheral extension 20 of the upper tool 11 and has the negative profile thereof. The separating surface 60 has a profile which is matched to the profile of the other separating surfaces 38, 45. The shaping surface 62 forms the reference plane of the tool and runs at right angles to the axis X—X. The fold formed by the lower edge of the closing slopes 64 can serve as a further reference plane and also runs perpendicular to the axis X—X.

If the tool according to the invention is now closed as shown in FIG. 6, the upper tool 11 being moved downwards by a pressure member, the still open edges of the fabric cutout 3 are rolled inwards by the closing slopes 64, 65 located in the lower tool 52. In accordance with the invention, the closing slopes 64 form an outer fold, the base of the fold being respectively in a plane perpendicular to the axis X—X, thus forming the reference plane of the tool. With further pressure on the upper tool the lower part 53 now gives way and the clasp lower part 2 is brought into the closed position (see FIG. 6). Now, by complete pressing together of the upper and lower tools, the clasp upper and lower parts are made to penetrate one another and the fabric cutout is thus fixed. On complete pressing together of the two tools the upper part and the inner core section of the upper tool as well as the lower part and the inner core section of the lower tool give way so that the clasp upper and lower parts are pressed together between the end faces of the outer core section 29 and the collar 59.

Here, the profile of the fold of the closing slopes 64 guarantees that the underside plane 7 runs perpendicular to the axis X—X in the unpressed state.

The present invention is not restricted to the exemplary embodiment shown but also includes all means acting in the same way in the manner of the invention. Thus, in accordance with the invention it is also possible for the end faces 62 and the plane running through the fold base of the closing slopes 64 to run inclined to the axis X—X in accordance with the inclination of the non-parallel upper and lower surface of the clasp with respect to one another, and for the surfaces 21, 25, 31 in the upper tool 11 and the corresponding surfaces 38, 45, 60 in the lower tools to run perpendicular to the axis X—X.

We claim:

1. A clasp comprising:

a clasp upper part (1) having a dish-shaped cross section to provide an upper surface and an open underside with downwardly facing edges;

a material (3) covering said clasp upper part (1), said material (3) having ends (9);

a clasp lower part (2) having a dish-shaped cross section to provide a lower surface and an open top side with upwardly facing edges;

said open top side of said clasp lower part (2) being pressed into said open underside of said clasp upper part (1) to provide an internal clasp space within said clasp for receiving said ends (9) of said material (3);

said upper surface of said clasp upper part (1) being inclined relative to said lower surface of said clasp lower part (2) when pressed together so that said upper and lower surfaces are non-parallel to each other;

said upper surface of said clasp upper part (1) being disposed in a first plane (4), and said edges of said open underside of said clasp upper part (1) being disposed in a second plane (7), said first plane (4) being inclined relative to said second plane (7);

said lower surface of said clasp lower part (2) being disposed in a third plane (5), and said edges of said open top side of said clasp lower part (2) being disposed in a fourth plane (6), said fourth plane (6) being inclined relative to said third plane (5);

said third plane (5) of said lower surface of said clasp lower part (2) being parallel to said second plane (7) of said edges of said open underside of said clasp upper part (1); and said fourth plane (6) of said edges of said open top side of said clasp lower part (2) being parallel to said first plane (4) of said upper surface of said clasp upper part (1).

2. A clasp according to claim 1, wherein said third plane (5) of said lower surface of said clasp lower part (2) is perpendicular to an axis (X—X) of closure of said clasp.

3. A clasp according to claim 1, wherein said upper surface of said clasp upper part (1) is bow-shaped.

4. A clasp according to claim 1, wherein said upper surface of said clasp upper part (1) is rectilinear.

* * * * *